US005408721A

United States Patent [19]

Wall et al.

[11] Patent Number: 5,408,721

[45] Date of Patent: Apr. 25, 1995

[54] AUTOMATIC DUSTPAN MEMBER FOR CENTRAL VACUUM CLEANING SYSTEM

[76] Inventors: James C. Wall, 6807 NE. 151st Way, Vancouver, Wash. 98686; Buzz L. Siler, 3328 Lakeview Blvd., Lake Oswego, Oreg. 97035

[21] Appl. No.: 174,194

[22] Filed: Dec. 27, 1993

[51] Int. Cl.[6] ..... A47L 5/38

[52] U.S. Cl. ..... 15/301; 15/339

[58] Field of Search ..... 15/301, 310, 314, 339

[56] References Cited

U.S. PATENT DOCUMENTS

| | | | |
|---|---|---|---|
| 3,027,587 | 4/1962 | Bierstock | 15/301 |
| 3,027,588 | 4/1962 | Bierstock | 15/301 |
| 5,083,704 | 1/1992 | Rounthwaite | 15/314 X |
| 5,279,016 | 1/1994 | Klassen | 15/301 |

FOREIGN PATENT DOCUMENTS 675552 12/1963 Canada .

*Primary Examiner*—Christopher K. Moore
*Attorney, Agent, or Firm*—Olson & Olson

[57] ABSTRACT

An automatic dustpan apparatus for central vacuum cleaning systems has a hollow body member that is configured for built-in mounting under cabinetry or in walls adjacent a floor surface, and connection to a conventional central vacuum cleaning system whereby debris on a floor surface may simply be swept to the vicinity of the automatic dustpan and hence into the central vacuum cleaning system where it is discarded. A valve within the dustpan body automatically closes when the dustpan is not in use to permit the other receptacles in the central vacuum cleaning system to function and provision is made to assure against the energizing of the central vacuum cleaning motor when the automatic dustpan is to be used until after the valve of the dustpan has been opened, in order to prevent harmful overloading and other undue damaging strains on the motor during its initial startup and operation.

6 Claims, 4 Drawing Sheets

AUTOMATIC DUSTPAN MEMBER FOR CENTRAL VACUUM CLEANING SYSTEM

BACKGROUND OF THE INVENTION

This invention relates to central vacuum cleaning systems, and more particularly to a debris-collecting dustpan apparatus that is arranged for built-in mounting in various areas of the house and connection to the central vacuum cleaning system for operation of the latter to effect pickup and discard of dust and debris swept to the dustpan member simply and easily with a broom.

Home central vacuum cleaning systems are well known in the art and one gaining increased popularity in new house construction. Typically, a main power unit and debris receptacle is maintained at a remote point in a house, usually in the garage, the vacuum unit servicing a number of wall receptacles through pipe ductwork, the wall receptacles removably receiving a hose which mounts a vacuum cleaner-type wand which in turn mounts desired floor, furniture or brush attachments. Provision is made so that each wall receptacle automatically seals when not in use, so that full suction will be provided to a particular receptacle that is in use at the time. Without this provision, the entire central vacuum cleaning system would be rendered inoperable because there would not be adequate suction at the wand for suitable vacuuming. Accordingly, any attachment or end piece for a central vacuum cleaner system must necessarily be configured to close into a sealed condition when not in use so that the rest of the central vacuum system can be operated.

Vacuum-operated dustpan-type units have been provided heretofore, the most relevant devices being illustrated in U.S. Pat. Nos. 3,027,587 and '588 and Canadian Patent No. 675,552, all issued to the Canadian inventor H. Bierstock. However, each of these patents teach puzzlingly complex constructions that are arranged to automatically extend and retract telescopic nozzle members into and out of specially designed storage compartments beneath specially designed cabinetry.

Thus, while central vacuum cleaning systems have long been recognized for their benefits in eliminating the need for using, maintaining and storing conventional vacuum cleaners, and the nuisances of lugging them throughout a house between electrical outlets that are invariably hidden behind furniture and such, and require frequent filter bag replacements to maintain optimum performance, etc., it has also been discovered that it can also be a nuisance in the case of a central vacuum cleaner system to have to constantly contend with the long length of hose and returning it to storage in dealing with simple and frequent jobs of cleaning up after spills and in high traffic areas like kitchens, laundry rooms, entryways etc. that accumulate debris much faster than other areas of the house. In these instances, one normally uses a broom and a dustpan, which involves bending and stooping, manually discarding collected debris, and over time, invariably an extremely dusty storage closet that eventually collects the dust particles that remain on the dustpan after use. There is therefore seen a need for a convenient, economical, stationary dustpan-like attachment that is operable with a central vacuum cleaning system that may be installed, for example, in a kitchen, an entryway, a laundry room, a garage and the like and configured so that the dustpan may be operated to activate the central vacuum cleaning system so that as debris on a floor or counter is simply swept toward the dustpan member, the debris will be drawn into the dustpan member and hence, through the piping to the central vacuum debris receptacle, making the minor cleanup job as simple and quick as possible for the home owner.

SUMMARY OF THE INVENTION

In its basic concept this invention provides an automatic dustpan unit for attachment to a central vacuum cleaner system, the automatic dustpan unit having a valve arrangement configured to open the suction pipe to the central vacuum cleaning system and activate the central vacuum cleaning system when the dustpan is in use, and deactivate the central vacuum cleaning system and seal the suction pipe at the automatic dustpan when the dustpan is not in use and when the central vacuum cleaner system is being operated in conjunction with other receptacles and dustpan members elsewhere in the system.

It is by virtue of the foregoing basic concept that the principal objective of this invention is achieved; namely, the provision of a dustpan attachment unit for central vacuum cleaning systems which overcomes the limitations and shortcomings of central vacuum cleaning systems presently in use and to further enhance the desirability and saleability of central vacuum cleaning systems in the marketplace.

Another object of this invention is to provide an automatic dustpan attachment unit for central vacuum cleaning systems which is configured to be operated without requiring any bending or stooping of the operator, nor require any cleaning-related activity other than simple sweeping.

Another object of this invention is to provide an automatic dustpan attachment for central vacuum cleaning systems which is of simplified construction for economical manufacture and reliability in use.

A still further object of this invention is the provision of an automatic dustpan attachment apparatus for a central vacuum cleaning system which may be configured for mounting under standard cabinetry such as in kitchen and bathroom counter cabinets and the like, and also directly in walls in areas of houses where such cabinetry is not present.

The foregoing and other objects and advantages of this invention will appear from the following detailed description, taken in connection with the accompanying drawings of preferred embodiments.

BRIEF DESCRIPTION OF THE DRAWINGS

FIG. 4, similar to FIG. 3, illustrates the device with the lever arm moved into the "on" position illustrated in FIG. 2A, while FIG. 3 illustrates the device in the "off" position illustrated in FIG. 2.

DESCRIPTION OF THE PREFERRED EMBODIMENTS

Figure 7:
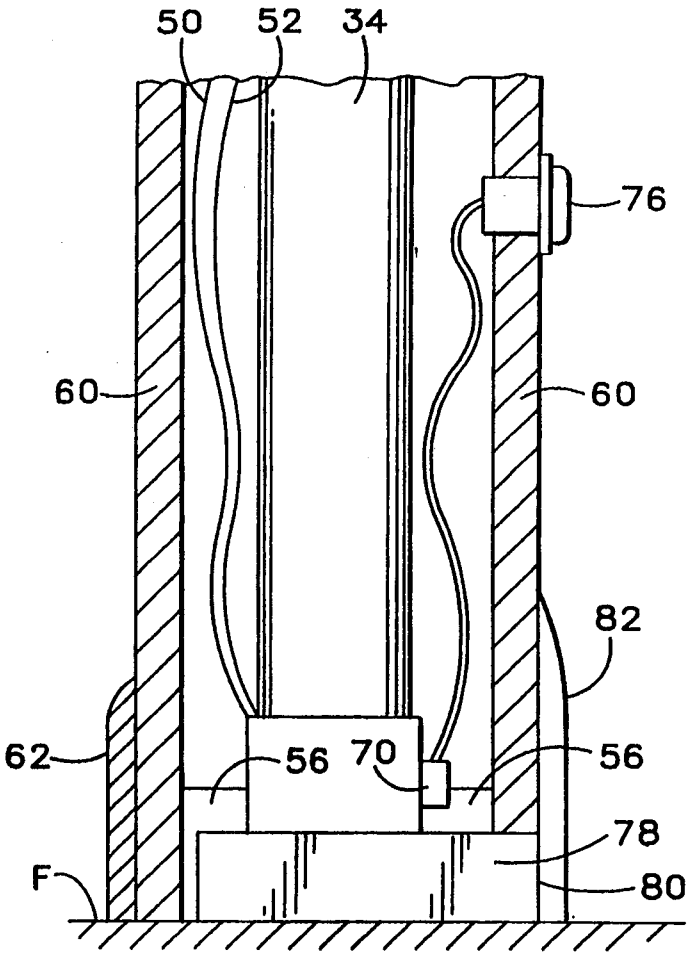
FIG. 7 is a fragmentary sectional view of a wall near a floor surface and illustrating an alternative wall-mounted embodiment of the invention.
Figure 6:
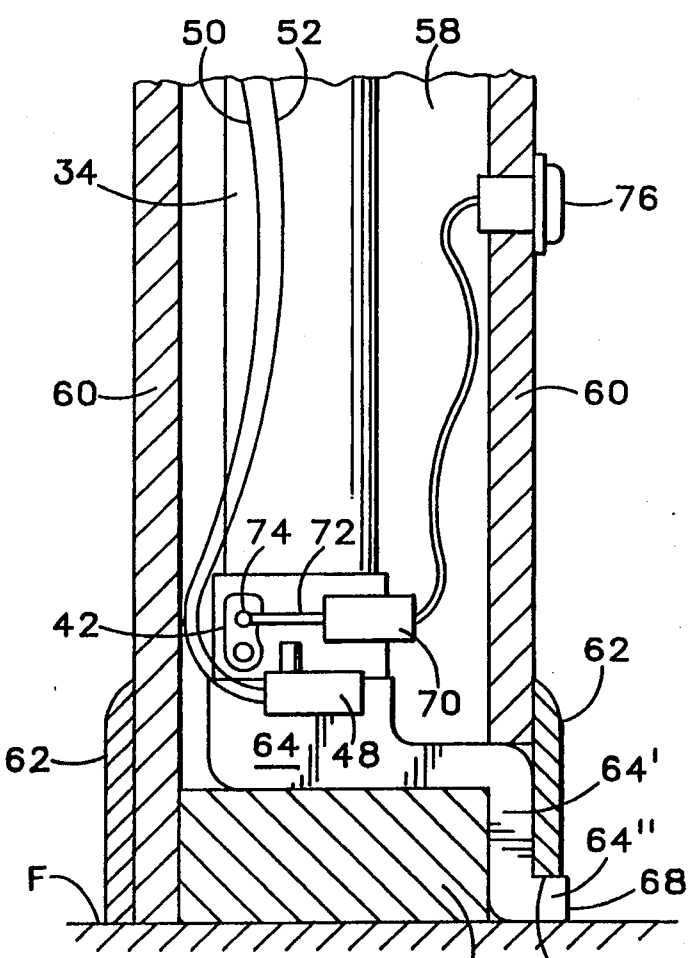
FIG. 6 is a fragmentary sectional view taken through a wall near a floor surface, and illustrating an in-wall mounted embodiment of the invention.

FIGS. 1-5 illustrate one embodiment of the present invention configured for installation in the toe-kick recess of cabinetry typically provided in homes and under counters in kitchens, bathrooms, laundry rooms and the like. FIGS. 6 and 7 illustrate alternative embodiments of the invention installed in wall spaces near floors in all areas throughout a house. The embodiments of FIGS. 6 and 7 may also be provided, to dispose the inlet opening at counter level, instead of the floor level illustrated, if so desired for easy counter maintenance and clean up. Any one or a combination of these dustpan attachment embodiments may be used with and added on to a conventional central vacuum cleaning system without in any way adversely effecting the proper performance of the central vacuum cleaning system either at the dustpan or dustpans or at the conventional vacuum hose-receiving receptacles provided throughout a house.

Referring first to the embodiment of FIGS. 1-5, standard cabinets or below counter cabinets 10 are illustrated being supported on a floor surface 12 by a recessed toe-kick baseboard wall 14 extending downwardly from the bottom wall 16 of the cabinets. As seen in FIGS. 2-5, the toe-kick baseboard 14 is provided with a cutout portion 18 to allow mounting of the automatic dustpan body now to be described.

An automatic dustpan body member is configured to form a hollow chamber having a back wall 20, side walls 22, bottom wall 24, top wall 26 and a preferably sloping, preferably removable front cover wall 28 that closes the front of the hollow chamber except for a laterally extending nozzle-forming inlet opening 30 through which debris will be drawn by the suction operation of the vacuum cleaning system as will be described later. The front cover 28 may also include angled side members 28' which extend to the floor surface and are provided to assist in the sweeping of debris from under the toe-kick outwardly toward the suction nozzle opening 30. The rear wall 20 of the hollow chamber is provided with an outlet opening 32 configured for attachment to the conventional piping 34 of a central vacuum cleaner system (not shown). The hollow body member is configured to be securely mounted fixedly to the baseboard 14, as by mounting screws S, so that the inlet opening 30 is secured in position overlying the floor surface within the toe-kick recess.

Of critical importance to this invention and its successful operation in connection with a conventional central vacuum cleaning system is the provision of suitable valve/sealing means which interacts with a central vacuum system energizing means to assure the operational integrity of the conventional central vacuum cleaning system with the automatic dustpan attachments connected thereto.

The foregoing is achieved in this embodiment by the valve structure illustrated in FIGS. 2-5 of the drawings. As illustrated, a downwardly extending flap member 36 is mounted within the hollow body member immediately adjacent the outlet opening 32 by pivot supports 38. This flap member is mounted within the body member so that, when it is in downwardly-depending condition, it is in abutment with and closes off the oulet opening 32. If so desired, a gasket 40 or other seal-enhancing material may be provided between the flap member and the outlet to insure a positive, substantially air-type seal when the central vacuum cleaning system is activated and suction is being applied through pipe 34 when the flap member 36 is in its normally downwardly-depending, closed position when the dustpan member is not in use.

Means for operating the valve to selectively open the hollow body member to the suction supplied by the central vacuum cleaner system through pipe 34 is provided. In this embodiment, a projecting pivot tab member 42 is secured to the pivot post 36' of the flap member 36 so that rotation of the tab member effects rotation of the flap member 36 on its pivot 36', 38 between the downwardly-depending closed condition shown in FIG. 3 and the rotated, open condition shown in FIG. 4.

As seen in the drawings, a foot-operated lever arm 44 is mounted on the hollow body member by pivot 46. As is evident in FIGS. 1, 2 and 2A of the drawings, when the forward, exposed end 44' of the lever arm is engaged by the toe of a shoe and moved from the "off" position shown in FIGS. 1 and 2 to the "on" position of FIG. 2A, (to the right in FIG. 1), the arm is rotated about its pivot 46, and the opposite, inner end 44'' of the lever arm is moved into abutting contact with the projecting tab member 42. Continued movement of the lever arm rotates the tab and the pivot post 36' and hence opens the flap member 36.

Figure 1:
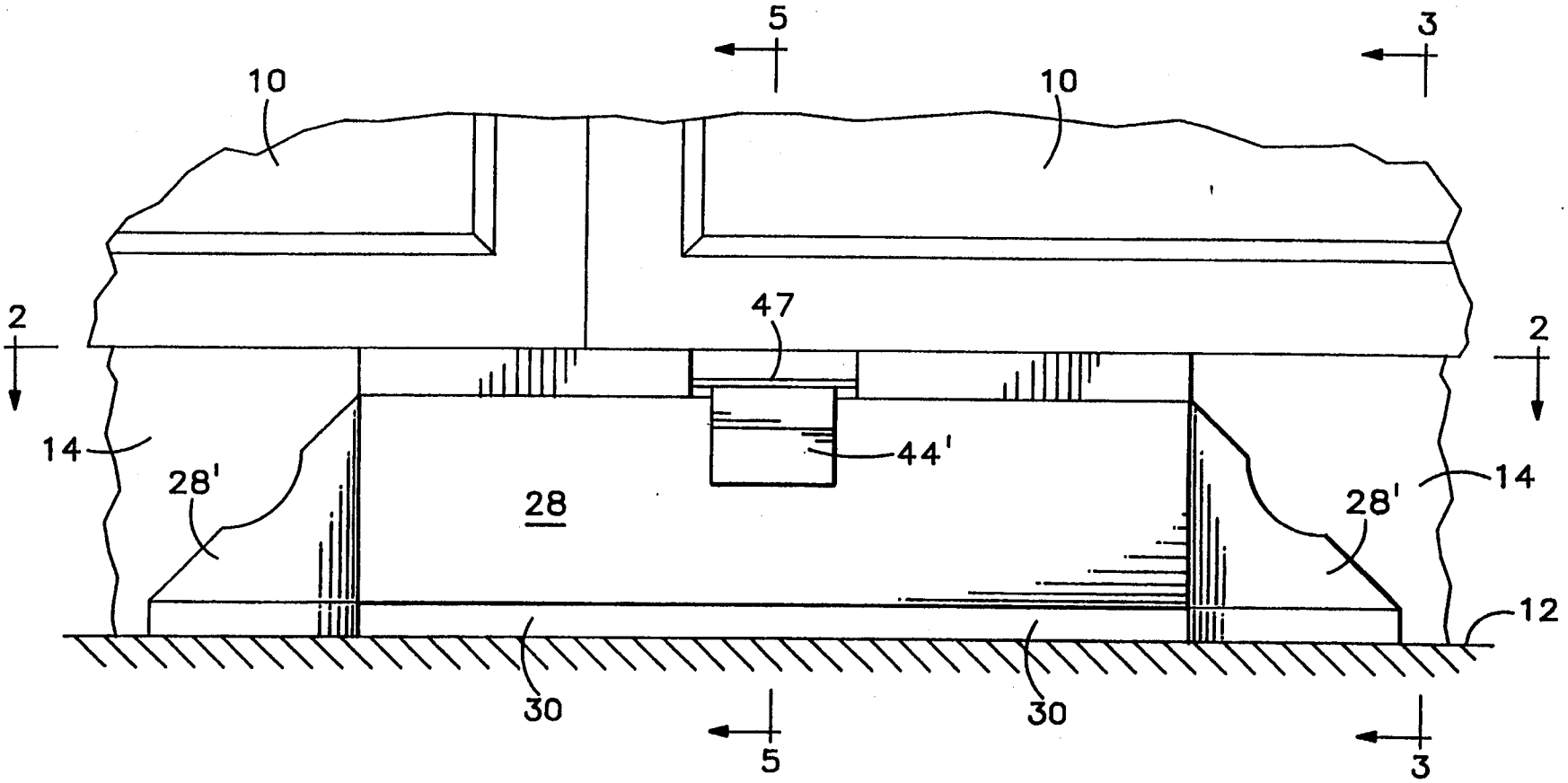
FIG. 1 is a fragmentary front elevation of an automatic dustpan member embodying the features of this invention mounted at floor level to the baseboard in the toe-kick recess of a kitchen counter cabinet.
Figure 2A:
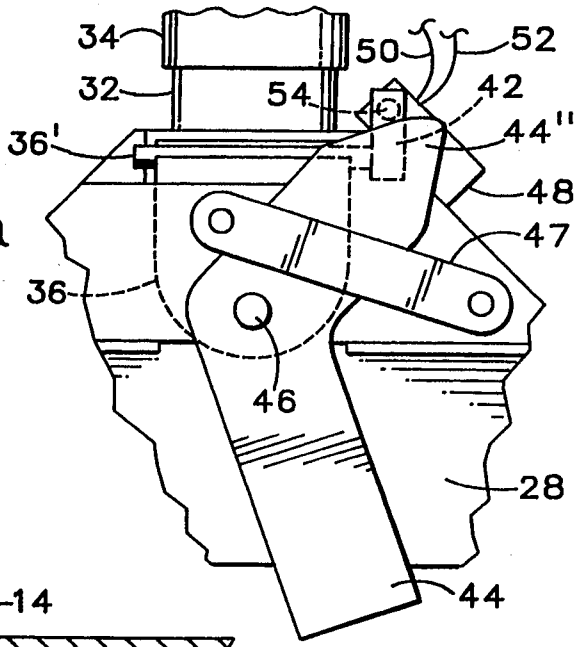
FIG. 2A is a fragmentary plan view of the mechanical structure shown in FIG. 2 but in operative, "on" position. The sealing valve, otherwise hidden from view, is shown in open condition in broken lines.
Figure 2:
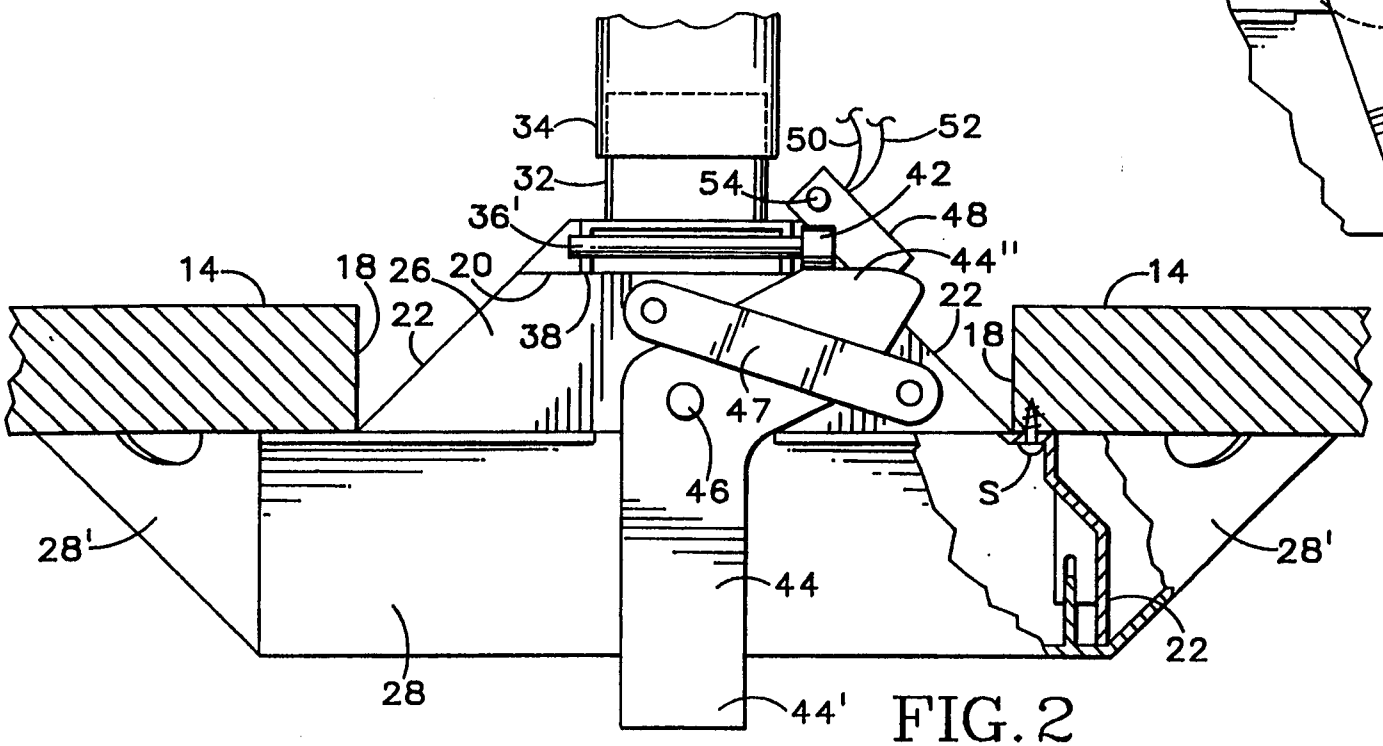
FIG. 2 is a fragmentary plan view of the automatic dustpan member illustrated in FIG. 1, taken along the line 2—2 in FIG. 1.
Figure 4:
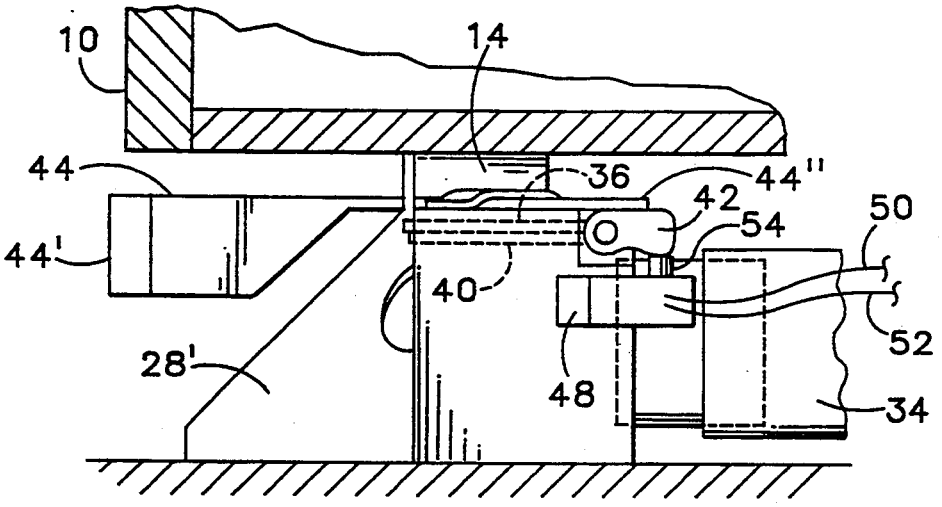
Figure 5:
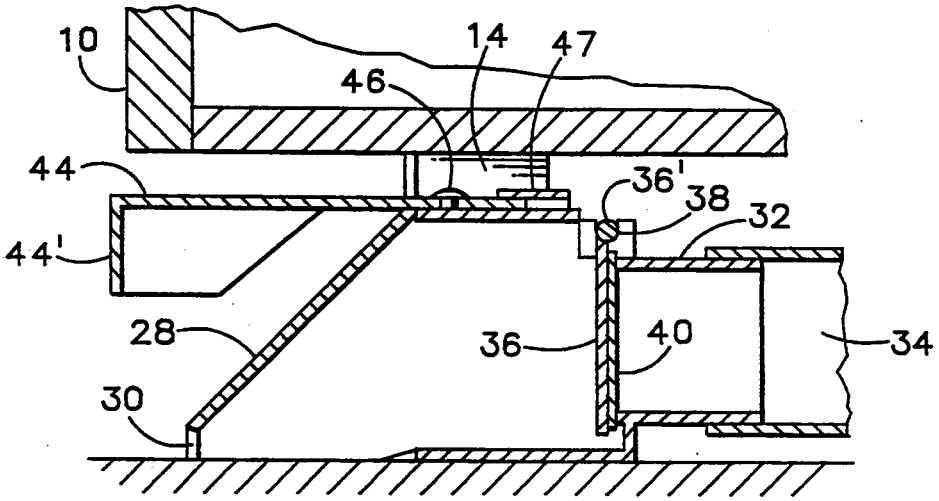
FIG. 5 is a fragmentary sectional view of the device shown in FIG. 1 of the drawings taken along the line 5—5 in FIG. 1.

As is clear in FIGS. 2A and 4, when the lever arm has been moved fully into its "on" position, its inner end 44' overlies the tab member 42 and retains the tab member in fully rotated position and securely maintains the flap member 36 in the open condition shown in FIG. 4. A friction guide strap 47 may be provided over the lever arm 44, as shown in FIGS. 2 and 2A, to increase the friction applied against the arm in order to assure against inadvertent movement of the arm from its on or off position and to assure that close tolerances are maintained between its inner end 44'' and the tab member 42.

Because the automatic dustpan of this invention must function in cooperation with a central vacuum cleaning system having a plurality of other independently operating receptacles throughout a house, means must be provided to energize or de-energize the central vacuum cleaning system at the dustpan member and only when the valve means, (flap member 36 in this embodiment), is in partially or fully open condition. In this regard, the present invention provides a structural interconnection between the valve means and a means for activating and de-activating the vacuum system.

Figure 3:
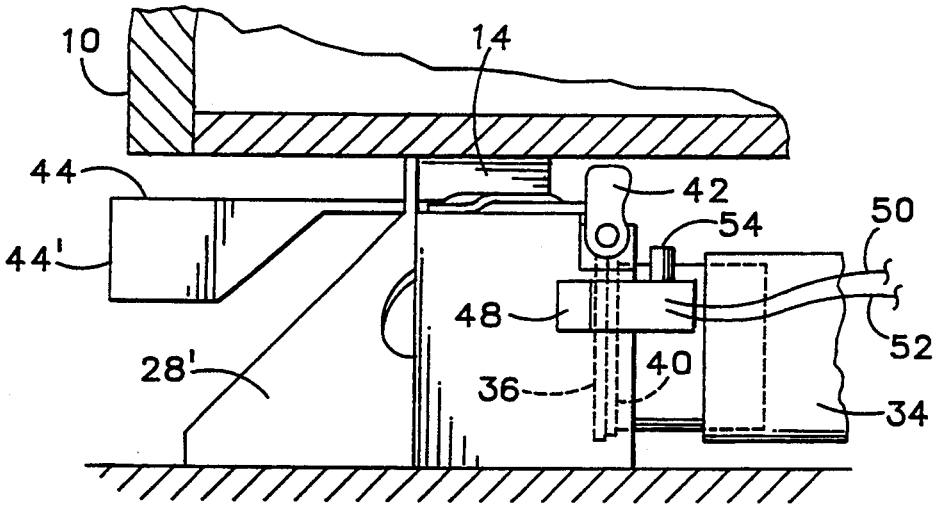
FIGS. 3 and 4 are fragmentary side elevations of the dustpan member shown in FIGS. 1 and 2, FIG. 3 being taken along the line 3—3 in FIG. 1.

As illustrated best in FIGS. 3 and 4 of the drawings, this embodiment of the invention includes a vacuum motor control switch 48 mounted on the body member and arranged to be operated by the action of the tab member 42. Specifically, the switch shown is a temporarily-on, spring-loaded, push button-type electrical switch having wires 50, 52 which are connected respectively to a source of electrical power and to the motor (not shown) of the central vacuum cleaning system. As will be understood, the, normally open switch, is closed and the vacuum motor activated when the spring-loaded push button 54 is manually depressed by the tab 42, and will remain closed until the spring loaded button 54 is released, thus deactivating the vacuum motor. Thus in this embodiment the tab 42 further serves as means for operating the vacuum motor control switch 48.

Thus, it will be readily apparent to those skilled in the art that movement of the lever arm 44 in one direction on its pivot mount 46 on the body member moves the end 44'' of the lever arm into abutment with the tab member 42, pivoting it and its associated flap member 36 on pivot mounts 38 and raising the flap member within the hollow body member and opening the interior of the dustpan to the suction pipe 34 connected to the central vacuum cleaning system. As the tab member 42 is rotated, a projecting lobe 42' on the tab member is moved into contact with the push button 54 depressing the latter until the switch is activated to energize the vacuum cleaner motor when the tab and its associated flap member has rotated to substantially full-open position. In the reverse manner, when the lever arm is moved in the opposite direction after use of the automatic dustpan, the movement of the tab member in the opposite direction first deactivates the vacuum motor while the tab and flap member are still being restrained from assuming fully closed position by the lever arm end 44''. Thus, the vacuum motor is protected against any chance of overloading due to the delayed or premature opening or closing of the valve means when the vacuum motor is operating. While the closing movement of the flap member 36 in this embodiment of the invention is assured by gravity, it is to be understood that the flap member could be weighted or spring tensioned to effect a more positive closing action if so desired or needed.

The operation of the automatic dustpan embodied in FIGS. 1–5 is readily apparent. With the automatic dustpan body mounted in the toe-kick recess of a kitchen cabinet for example, and connected to a central vacuum cleaning system, an operator simply moves the lever 44 to its "on" position (toward the right in FIG. 1) with the toe of his shoe. This causes tab 42 to rotate and raise the flap member 36 which opens the suction pipe 34. The tab 42 then engages button 54 and energizes the vacuum motor of the central vacuum cleaning system. The operator then simply sweeps the floor area toward the nozzle 30 of the automatic dustpan and the debris and dust is naturally drawn thereinto by the significant influx of air being drawn by the central vacuum cleaning motor. The debris, obviously, passes through the hollow body into the central vacuum system piping 34 where it is carried to the waste receptacle of the system. When the floor has been swept, the operator simply moves the lever arm in the opposite direction to its off position which effects de-activation of the vacuum motor and then permits the flap member to drop into its closed, downwardly-depending condition which effectively closes off the suction pipe 34.

When the central vacuum cleaner system is activated at a different location in the system, for example a hose receptacle or another automatic dustpan unit in a different room, the negative pressure created in pipe 34 by the activation of the vacuum motor "pulls" the flap member 36 tightly into closed condition against the outlet opening 32 and forms an effective seal which prevents air from being drawn through the dustpan body and into the pipe 34 which would reduce the resulting suction power available to the receptacle that was in fact being used. Accordingly, any number of automatic dustpan attachment units as may be needed or desired may be used in a central vacuum cleaning system without diminishing the performance of the system at any of its receptacles.

Referring now to the embodiment of FIG. 6 of the drawings, there is illustrated an automatic dustpan apparatus for central vacuum cleaning systems that is configured to be mounted entirely within a standard wall, for use in areas where the under-cabinet embodiment of FIGS. 1–5 is not practical, such as in entryways, garages and even for counter tops. For purposes of illustration, FIG. 2 is a section of an interior wall adjacent a floor F surface. As is conventional, a 2"×4" sill plate 56 is illustrated mounting a plurality of spaced apart vertically extending wall studs 58 to the floor. Sheet rock 60 form the walls surface for each side of the wall, and decorative base molding 62 is provided at the base of the wall. A central vacuum cleaning system suction pipe 34 is directed into the wall space between adjacent studs as shown.

In this embodiment, the hollow body member 64 is preferably a single piece member configured, as illustrated, to be disposed on top of the sill plate 56 and anchored in place to the wall framing. The body is configured with a nozzle portion 64', 64'' arranged, as shown, to extend downwardly along the sill plate and thence outwardly at the floor. Preferably, the nozzle portion 64' is approximately the same width as is the width of the sheetrock 60, so that with the sheet rock notched out for the nozzle, a flush surface is provided for the base molding 62 which will hide the nozzle portion 64' from view. The base molding 62 is provided with a notched out portion 66 configured to permit passage of the nozzle portion 64''. Nozzle portion 64'' terminates in a debris-receiving inlet opening 68 through which swept dust and debris is drawn as has been explained with inlet opening 30 in the previous embodiment. The body member may be as wide or narrow as desired for its particular need, limited in its width only by the space provided between adjacent wall studs as will be understood.

It will be obvious to those skilled in the art that with only minor, obvious engineering modifications, the previously described lever arm/sealing flap member/-power switch structure 36–54 could be easily adapted for use in this embodiment, and therefore a detailed internal view and description thereof is deemed unnecessary. For purposes of illustrating alternative structures that may be employed in any of the embodiments of the invention, FIG. 6 illustrates the previously described lever arm assembly 44 replaced with a convention solenoid 70 connected, by linkage 72 and pivot 74 to tab member 42 as described previously. The same type of push button electrical switch 48 as that described previously is mounted on the body member for operative contact by the tab member 42 as previously described. The solenoid 70 is operated by a wall switch 76 so that, for example, when the switch 76 is activated, the solenoid 70 operates to move the linkage 72 to the right in FIG. 6, pivoting the tab member 42 (and corresponding flap member) on its axis and ultimately activating the vacuum motor power switch 48 to energize the central vacuum cleaning system as has been previously described. When the switch 76 is activated again, the solenoid 70, as is conventional, operates to return the linkage 72 to its original, extended condition shown in FIG. 6, moving the tab member correspondingly and hence deactivating the vacuum motor power switch 48 and moving the sealing flap member into its closed position in which the suction pipe 34 is sealed.

FIG. 7 illustrates another embodiment of a wall unit similar to the embodiment of FIG. 6 but more advantageous in areas where larger and more voluminous debris is likely to be encountered that may tend to more easily foul the narrower nozzle passage 64', 64" of the earlier embodiment, such as in garages, workshops, patios and the like. In this embodiment, a section of the bottom sill plate 56 between adjacent wall studs is cut out in order to accommodate placement of a hollow body member 78 on the floor surface thereinbetween. In this manner, the body member may incorporate an open front end that will provide a wide nozzle opening 80 needed for passage of large debris directly into the dustpan body member without encountering the necessarily tortuous path required by the sill-mounted embodiment of FIG. 6. The valve means, the valve operating means, and the vacuum motor control switch may be of the type already described. A wall cover plate 82 may be provided as an alternative to notching out conventional baseboard molding.

From the foregoing it will be apparent to those skilled in the art that various changes other than those already discussed may be made in the size, shape, type, number and arrangement of parts described hereinbefore without departing from the spirit of this invention and the scope of the appended claims. For example, three widely-divergent body member configurations have been illustrated herein, and limitless other body configurations are possible for any number of different needs. Also, the particular valve arrangement and cooperating motor-energizing structure are illustrative of functional yet mechanically simplified arrangements that have been found to be entirely suitable for the purpose. However, it is to be understood that the mechanical structures illustrated herein are intended to be merely illustrative many different conventional valve arrangements that can be used to open and close the suction pipe 34 and structure to activate and de-activate a vacuum motor power switch at specific positions of the valve arrangement. These and other changes and modifications are envisioned in the automatic dustpan attachment for central vacuum cleaning systems of this invention.

Having thus described my invention and the manner in which it may be used, I claim:

1. An automatic dustpan apparatus configured for attachment to and operation with a central vacuum cleaning system having a plurality or separate, independently operable vacuum receptacles connected to a common vacuum cleaner motor by a duct work of suction-providing piping and whereby the activation and de-activation of the vacuum cleaner motor is controlled independently at each receptacle location in the system, the automatic dustpan apparatus comprising:

a) a body member having a debris-collecting chamber interconnecting a debris-receiving inlet opening on the body member and a suction-supplying outlet opening on the body member, the outlet opening configured for connection to a suction-providing pipe of a central vacuum cleaning system, the body member further configured for stationary mounting to a supporting structure to position the inlet opening of the body member in registry with a surface to be swept with said suction-supplying outlet opening of the body member disposed above the plane of a surface in registry with said inlet opening for connection of the outlet opening thereabove to a suction-providing pipe, b) valve means on the body member for selectively opening and closing the outlet opening to the passage of air therethrough during operation of the vacuum cleaner motor of the central vacuum cleaning system, c) valve-operating means on the body member for selectively operating the valve means to open and close the outlet opening, and d) a vacuum cleaner motor control switch to activate and de-activate the vacuum cleaner motor of the central vacuum cleaning system.

2. The automatic dustpan apparatus of claim 1 including control switch operating means engaging said valve means and said vacuum cleaner motor control switch for activating said vacuum cleaner motor control switch when the valve means is in substantially open position and de-activating the vacuum cleaner motor control switch when the valve means is operated to begin closing.

3. The automatic dustpan apparatus of claim 2 wherein the valve operating means comprises a user-operated lever arm mounted on the dustpan body member and configured for operative movement controlling the operation of the valve means to open and close the outlet opening, and said control switch operating means comprises a projecting member on the valve means configured for operative movement therewith into and out of engagement with the vacuum cleaner motor control switch when the lever arm on the body member is operated to open and close the valve means.

4. The automatic dustpan apparatus of claim 2 wherein said valve operating means comprises an electrically operated solenoid operatively engaging the valve means for selectively opening and closing the latter, the operation of the solenoid being controlled by a solenoid-actuation switch by which a user of the automatic dustpan apparatus may operate the solenoid to selectively open and close the valve means.

5. The automatic dustpan apparatus of claim 1 wherein the body member is configured to be fixedly anchored to the baseboard of a cabinet for stationary disposition of the debris-receiving inlet opening within the toe-kick recess of the cabinet.

6. The automatic dustpan apparatus of claim 1 wherein the body member is configured to be contained within an upstanding wall of a building for disposition of the debris-receiving inlet opening in registry with a surface to be swept.

* * * * *